United States Patent [19]

Hinca

[11] Patent Number: 4,903,423

[45] Date of Patent: Feb. 27, 1990

[54] SIGN HOLDER

[76] Inventor: William F. Hinca, 1145-A Whiterock Ave., Waukesha, Wis. 53186

[21] Appl. No.: 167,548

[22] Filed: Mar. 14, 1988

[51] Int. Cl.[4] ..... G09F 13/08; G09F 13/04

[52] U.S. Cl. ..... 40/205; 40/568; 40/574; 40/575; 40/564

[58] Field of Search ..... 40/202–206, 40/443, 541, 549, 553, 556, 568, 570, 576, 577, 585, 615, 574, 575; 362/812

[56] References Cited

U.S. PATENT DOCUMENTS

| | | | |
|---|---|---|---|
| 1,077,532 | 11/1913 | Hoehl | 40/549 |
| 1,475,866 | 11/1923 | Peterson | 40/553 |
| 1,820,912 | 9/1931 | Kelly | 40/564 |
| 2,147,560 | 2/1939 | Schupbach | 40/205 |
| 3,905,139 | 9/1975 | Cooper | 40/568 |

*Primary Examiner*—Richard J. Apley

*Assistant Examiner*—J. Welsh

*Attorney, Agent, or Firm*—Michael, Best & Friedrich

[57] ABSTRACT

Disclosed herein is a sign holder comprising a housing including a back wall, opposed and spaced side walls extending from the back wall and opposed and spaced top and bottom walls extending from the back wall and from the opposed side walls, a first panel of light transmitting plastic removably supported by the housing and providing a second panel of light transmitting plastic removably supported by the housing in closely adjacent but rearwardly spaced relation to the first panel and in forwardly spaced relation from the rear wall to provide an illumination space, an indicia on the second panel preventing light transmittal there-through, and a light bulb in the housing rearwardly of the second panel for illuminating the space between the second panel and the rear wall, whereby the indicia on the second panel is visually observable by being outlined by illumination.

4 Claims, 2 Drawing Sheets

SIGN HOLDER

BACKGROUND OF THE INVENTION

The invention relates generally to sign holders and, more particularly, to illuminated sign holders. The invention also relates to sign holders adapted to be mounted on the bumper of a vehicle or on a building or house.

Attention is directed to the following U.S. Pat. Nos.:
892,658
1,122,279
1,510,952
1,568,907
2,696,058
D-163,421

SUMMARY OF THE INVENTION

The invention provides a sign holder comprising a housing including a back wall, opposed and spaced side walls extending from the back wall, and opposed and spaced top and bottom walls extending from the back wall and from the opposed side walls, a panel of light transmitting plastic removably supported by the housing in forwardly spaced relation from the rear wall to provide an illumination space, an indicia on the panel for varying the light transmitted there-through, and a light bulb in the housing rearwardly of the panel for illuminating the space between the panel and the rear wall, whereby the indicia on the panel is visually observable by reason of the variation in light transmission through the panel.

The invention also provides a sign holder comprising a housing including a back wall, opposed and spaced side walls extending from the back wall and opposed and spaced top and bottom walls extending from the back wall and from the opposed side walls, a first panel of light transmitting plastic removably supported by the housing and providing a front wall, a second panel of light transmitting plastic removably supported by the housing in closely adjacent but rearwardly spaced relation to the first panel and in forwardly spaced relation from the rear wall to provide an illumination space, an indicia on the second panel preventing light transmittal there-through, and a light bulb in the housing rearwardly of the second panel for illuminating the space between the second panel and the rear wall, whereby the indicia on the second panel is visually observable by being outlined by illumination.

The invention also provides a sign holder comprising a housing including a main body having a back wall, opposed and spaced side walls extending from the back wall, and a bottom wall extending from the back wall and from the opposed side walls, a cover releaseably secured to the main body and including a back wall, opposed and spaced side walls extending from the cover back wall, and a top wall extending from the cover back wall and from the cover side walls, which cover also includes an upper front wall having therein a colored light transmitting lens, a first panel of clear light transmitting plastic supported by the housing, a second panel of light transmitting plastic removably supported by the housing in closely adjacent but rearwardly spaced relation from the first panel and in forwardly spaced relation from the rear wall to provide rearwardly of the second panel an illumination space, an indicia located on the second panel and being obtuse to light transmittal there-through, and a light bulb in the housing rearwardly of the second panel for illuminating the space between the second panel and the rear wall, whereby the indicia on the second panel is visually observable by reason of variation in illumination, and a projection on one of the main body and the cover and a recess located in the other of the main body and the cover and receiving the projection to locate the cover and the main body in alignment with each other.

Other features and advantages of the invention will become known by reference to the following general description, claims and appended drawings.

THE DRAWINGS

Figure 1:
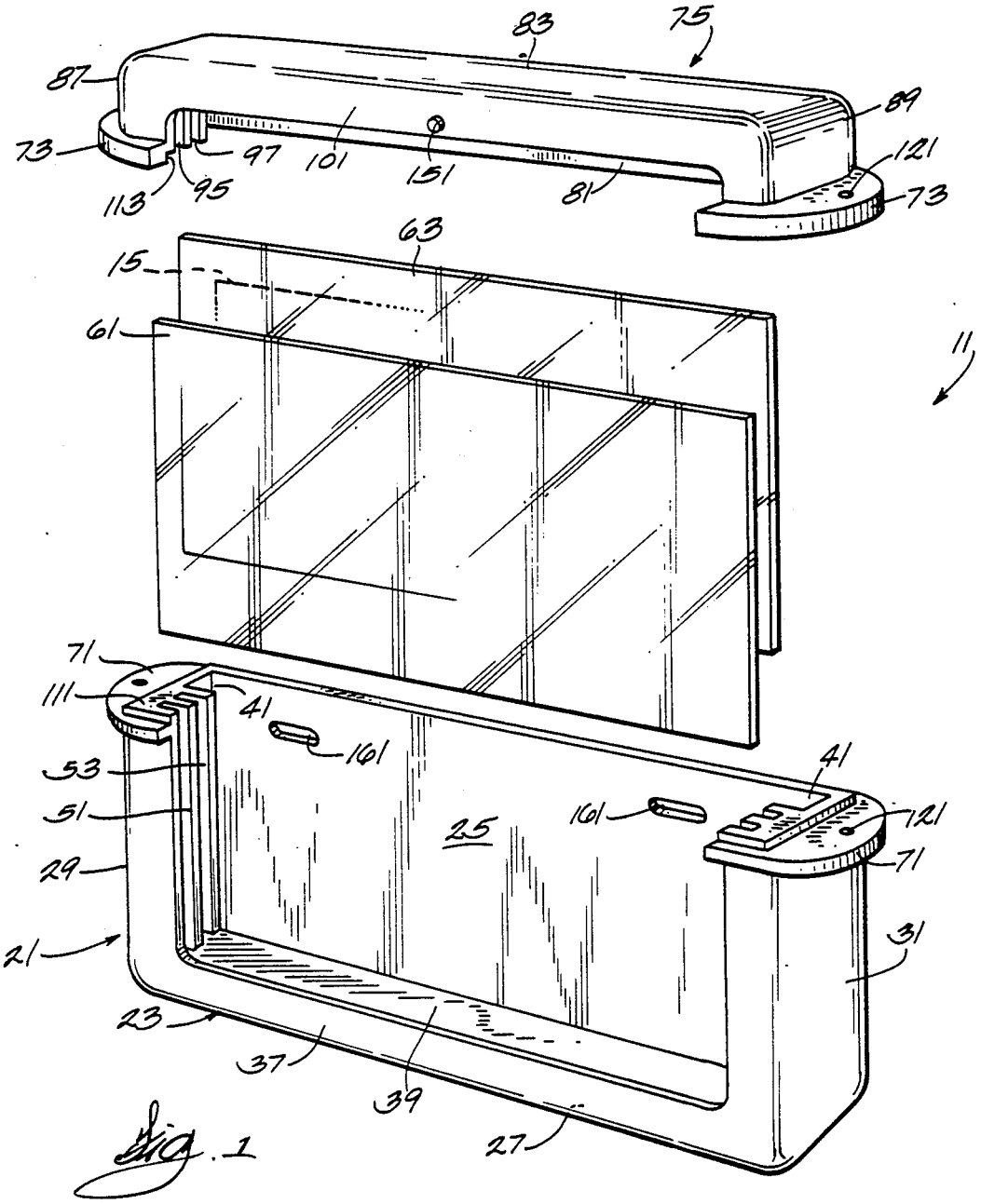
FIG. 1 is an exploded perspective view of a sign holder incorporating various of the features of the invention.
Figure 4:
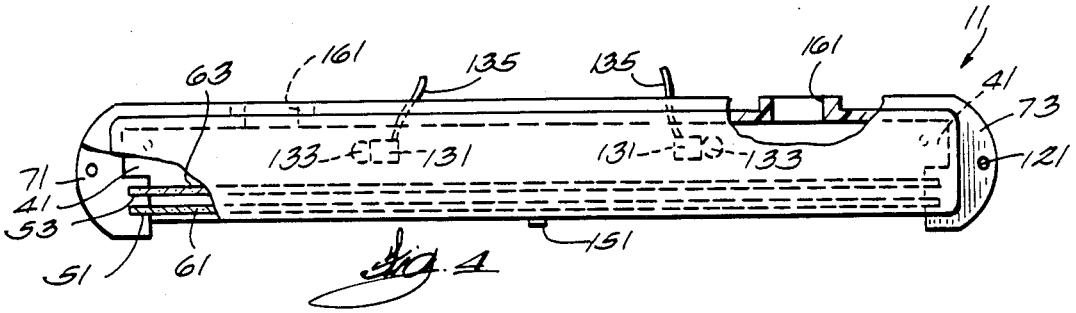
FIG. 4 is a top view, with parts broken away and in section, of the sign holder shown in FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Illustrated in the drawings is an illuminated sign holder 11 which is adapted to be mounted on an automobile bumper, or alternatively, which is adapted to be mounted on a house or other building and to display an indicia 15 such as an appropriate street number or family name. Alternatively, the sign holder 11 can be employed to display any indicia 15 which can be personalized, as for instance, initials, a logo, or the like.

Figure 5:
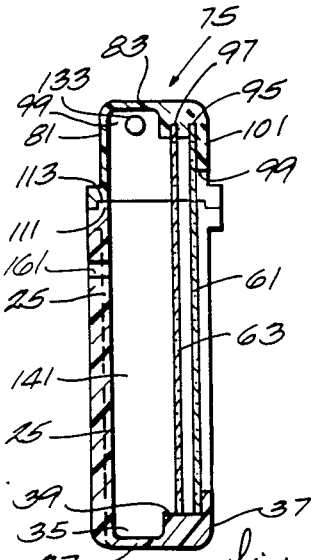
FIG. 5 is a sectional view taken along line 5—5 of FIG. 2.

The sign holder 11 includes a housing 21 comprising a main body 23 including a rear or back wall 25, a bottom wall 27 extending from the bottom of the back wall 25, and a pair of opposed side walls 29 and 31 which respectively extend from the opposite side ends of the back wall 27 and from the opposite side ends of the bottom wall 27. The bottom wall 27 includes, along the length thereof, (see FIG. 5) an upwardly open recess 35 which provides or defines a lower front wall 37. Forwardly of the recess 35, the bottom wall also define a ledge 39.

Each of the side walls 24 and 31 includes an inwardly and laterally open recess 41 which is of generally the same for and aft dimension as the recess 35 in the bottom wall 27 and which communicates with the bottom wall recess 35.

In addition, each of the side walls 29 and 31 also includes, forwardly of the recess 41, a pair of slightly spaced groves 51 and 53 which extend parallel to the recess 41, which are of relatively thin dimension in the fore and aft direction, and which are respectively adapted to selectively receive first and second, or front and rear, Panels or panes 61 and 63 of plastic, such as lexan or plexiglass. At their lower ends, as shown best in FIG. 5, the plastic panels 61 and 63 rest on the ledge 39.

The main body 23 also includes, at the top thereof, and along the side walls 29 and 31 and rear wall 25, a laterally outwardly extending flange 71 adapted to mate with a corresponding flange 73 on a cover 75.

The cover 75 includes (see FIG. 5) a rear wall 81, a top wall 83 extending forwardly from the top of the rear wall 81, and a pair of opposed and spaced side walls 87 and 89 respectively extending from the opposed side ends of the rear wall 81 and from the side ends of the top wall 83.

The cover side walls 87 and 89 respectively include (see FIG. 5) recesses 95 and 97 corresponding generally to the recesses 51 and 53 in the side walls 29 and 31 of the main body 23. The cover top wall 83 is also recessed in a manner similar to the main body bottom wall 27 to provide a recess 99 defining a front wall 101.

Figure 6:
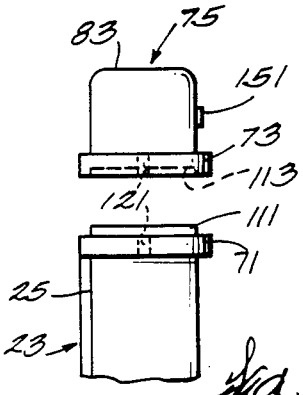
FIG. 6 is an exploded, partial side view of the sign holder shown in FIG. 1.

In addition to the foregoing, the main body 23 of the housing 21 and the cover 75 include pilot means for locating their respective flanges 71 and 73 in mating engagement. More specifically, the sides of the flange 71 on the main body 23 include (see FIG. 6) upwardly extending projections 111 which are received in mating recesses 113 in the adjacent surface of the cover flange 73, whereby to afford alignment of the cover 75 and main body 23 and to preclude fore and aft movement, and side to side movement, of the cover 75 relative to the main body 23.

Figure 2:
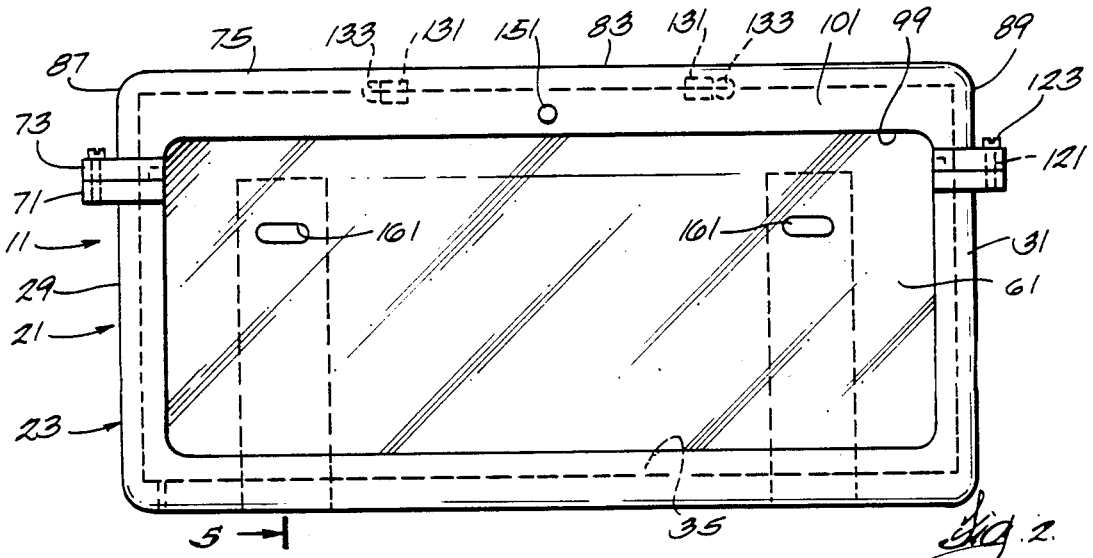
FIG. 2 is a front elevational view of the sign holder shown in FIG. 1.
Figure 3:
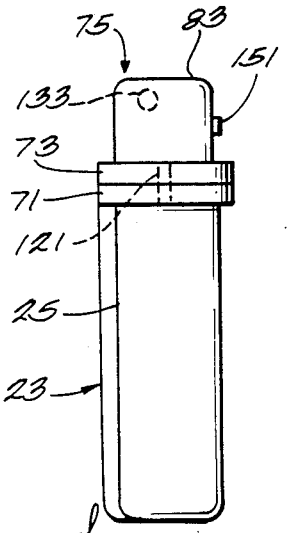
FIG. 3 is a side elevational view of the sign holder shown in FIG. 1.

In addition, the flanges 71 and 73 can be provided with mating apertures 121 for facilitating insertion of one or more self tapping screws 123 (see FIG. 2) to fixedly and removable secure together the main body 23 and the cover 75, and thereby to complete the housing 21.

Mounted in the cover 75 are one or more electrical receptacles or sockets 131 receiving therein respective light bulbs 133 which can provide white light or colored light and which are energized through leads 135 which can extend to a battery (not shown) in a vehicle or to any other suitable source of electrical energy.

The front plastic panel or pane 61 is clear and is provided for protection, and if desired, can be dispensed with. The rear panel or pane 63 can be white or colored plastic which is provided with the desired indicia 15 such as a logo or other identifying information which is at least partially obtuse to light transmission and which is thereby outlined by the illumination present in the space 141 (see FIG. 5) between the rearward panel or pane 63 and the rear wall 25. As a consequence, the light present in the space between the rear wall 25 and the rear panel 63 is transmitted around the indicia 15, and/or partially through the indicia 15. Such information or indicia 15 can be applied to the rear panel or pane 63 by hand painting, or by lettering, or by silk screening, or by computer generated mechanisms.

Preferably, the front wall 101 of the cover is apertured and provided with a colored lens 151 to provide an indication viewable even in the daytime that the bulb(s) 133 in the space 141 are energized.

Preferably, the main body rear wall 25 includes a pair of openings 161 affording attachment of the sign holder 11 to a wall (not shown) as by the use of screws (not shown).

While a single socket 131 and bulb 133 can be used, several sockets 131 and bulbs 133 can be employed. In addition, if desired, when more than one socket or receptacle 131 is employed, bulbs 133 of different colors can be employed in different sockets 131.

Various of the features of the invention are set forth in the following claims:

I claim:

1. A sign holder comprising a housing including a main body comprising a back wall, and opposed and spaced side walls extending from said back wall, each of said side walls having therein a forward groove and a rearward groove spaced rearwardly from said forward groove, and said main body also comprising a bottom wall extending from said back wall and from said opposed side walls, and said housing also including a cover releaseably secured to said main body and comprising a back wall, and opposed and spaced side walls extending from said cover back wall, each of said cover side walls having therein a forward groove and a rearward groove spaced rearwardly from said cover forward groove, and said cover also comprising a top wall extending from said cover back wall and from said cover side walls, and said sign holder also comprising a first light transmitting panel supported by said housing in said forward grooves of said main body and of said cover, a second panel removably supported by said housing in said rearward grooves of said main body and of said cover and in closely adjacent but rearwardly spaced relation from said first panel and in forwardly spaced relation from said back walls to provide rearwardly of said second panel an illumination space, an indicia located on said second panel, one of said second panel and said indicia being obtuse to light transmittal and the other of said second panel and said indicia being clear, and a light bulb in said housing rearwardly of said second panel for illuminating the space between said second panel and said back walls, whereby said indicia on said second panel is visually observable by reason of variation in illumination.

2. A sign holder in accordance with claim 1 wherein one of said main body and said cover includes a projection and the other of said main body and said cover includes a recess receiving said projection to locate said cover and said main body in alignment with each other.

3. A sign holder according to claim 1 wherein said cover also comprises an upper front wall having therein a colored light transmitting lens.

4. A sign holder comprising a housing comprising a main body including a back wall, and opposed and spaced side walls extending from said back wall, each of said side walls having therein a forward groove and a rearward groove spaced rearwardly from said forward groove, and said main body also including a bottom wall extending from said back wall and from said opposed side walls, and said housing also comprising a cover releaseably secured to said main body and including a back wall, and opposed and spaced side walls extending from said cover back wall, each of said cover side walls having therein a forward groove and a rearward groove spaced rearwardly from said over forward groove, and said cover also including a top wall extending from said cover back wall and from said cover side walls, and an upper front wall having therein a colored light transmitting lens, and said sign holder also comprising a first panel of clear light transmitting plastic supported by said housing in said forward grooves of said main body and of said cover, a second panel of light transmitting plastic removable supported by said housing in said rearward grooves of said main body and of said cover and in closely adjacent but rearwardly spaced relation from said first panel and in forwardly spaced relation from said back walls to provide rearwardly of said second panel an illumination space, an indicia located on said second panel and being obtuse to light transmittal therethrough, a light bulb in said housing rearwardly of said second panel for illuminating the space between said second panel and said back walls, whereby said indicia on said second panel is visually observable by reason of variation in illumination, and a projection on one of said main body and said cover and a recess in the other of said main body and said cover and receiving said projection to locate said cover and said main body in alignment with each other.

* * * * *